US011846008B1

(12) United States Patent
Chaput et al.

(10) Patent No.: US 11,846,008 B1
(45) **Date of Patent: *Dec. 19, 2023**

(54) NIOBIUM ALLOYS FOR HIGH TEMPERATURE, STRUCTURAL APPLICATIONS

(71) Applicant: Government of the United States, as represented by the Secretary of the Air Force, Wright-Patterson AFB, OH (US)

(72) Inventors: Kevin J. Chaput, Beavercreek, OH (US); Oleg N. Senkov, Fairborn, OH (US); Todd M. Butler, Beavercreek, OH (US); Satish I Rao, Springboro, OH (US)

(73) Assignee: United States of America as represented by Secretary of the Air Force, Wright-Patterson AFB, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/568,414

(22) Filed: Jan. 4, 2022

Related U.S. Application Data

(63) Continuation of application No. 16/916,198, filed on Jun. 30, 2020, now abandoned.

(60) Provisional application No. 62/906,234, filed on Sep. 26, 2019.

(51) Int. Cl.
*C22C 27/02* (2006.01)

(52) U.S. Cl.
CPC ..... *C22C 27/02* (2013.01)

(58) Field of Classification Search
None
See application file for complete search history.

(56) References Cited

U.S. PATENT DOCUMENTS 2,822,268 A 2/1954 Hix
2,838,395 A 6/1958 Rhodin
2,881,069 A 4/1959 Rhodin
2,882,146 A * 4/1959 Rhodin, Jr. ..... C22C 27/02 420/583

(Continued)

FOREIGN PATENT DOCUMENTS

EP 288678 A2 2/1988
EP 374507 A1 6/1990

(Continued)

OTHER PUBLICATIONS

Guminski, C. "The Hg-Nb System", 1993, J. Phase Equilibria, vol. 14, No. 3, p. 388-390. (Year: 1993).*

(Continued)

*Primary Examiner* — Xiaobei Wang
(74) *Attorney, Agent, or Firm* — AFMCLO/JAZ; James F. McBride

(57) ABSTRACT

The present invention relates to Nb-based refractory alloys that are less expensive and less dense than current Nb-based refractory alloys, have better ductility than current Nb-based refractory alloys, yet which have similar or better high temperature strengths and oxidation resistance when compared to current Nb-based refractory alloys. Such Nb-based refractory alloys typically continue to be compatible with current coating systems for Nb-based refractory alloys. Such Nb-based refractory alloys are disclosed herein.

6 Claims, 8 Drawing Sheets

(56) References Cited

U.S. PATENT DOCUMENTS

| | | | | |
|---|---|---|---|---|
| 2,985,531 | A | 5/1961 | Gordon et al. | |
| 3,001,870 | A | 9/1961 | McCullough et al. | |
| 3,022,163 | A | 2/1962 | Lottridge et al. | |
| 3,027,255 | A | 3/1962 | Begley et al. | |
| 3,043,683 | A | 7/1962 | Hix | |
| 3,046,109 | A | 7/1962 | Lottridge | |
| 3,125,445 | A | 3/1964 | Lottridge | |
| 3,152,891 | A | 10/1964 | Begley | |
| 3,156,560 | A | 11/1964 | Semmel | |
| 3,206,305 | A | 9/1965 | Begley et al. | |
| 3,346,379 | A | 10/1967 | Rohin | |
| 3,366,513 | A | 1/1968 | Barber et al. | |
| 3,395,012 | A | 7/1968 | McAdam et al. | |
| 3,639,180 | A | 2/1972 | Kelcher | |
| 3,682,626 | A | 8/1972 | Begley et al. | |
| 3,830,670 | A | 8/1974 | Van Thyne et al. | |
| 4,299,625 | A | 11/1981 | Michel et al. | |
| 4,836,849 | A | 6/1989 | Svedberg et al. | |
| 4,931,254 | A | 6/1990 | Jackson | |
| 4,983,358 | A | 1/1991 | Hebsur et al. | |
| 5,000,913 | A | 3/1991 | Jackson | |
| 5,006,307 | A | 4/1991 | Jackson | |
| 5,284,618 | A | 2/1994 | Allouard et al. | |
| 5,366,565 | A | 11/1994 | Jackson | |
| 6,238,491 | B1 * | 5/2001 | Davidson | C22C 30/00 606/76 |
| 7,981,520 | B2 * | 7/2011 | Bewlay | B32B 15/01 428/641 |
| 8,512,485 | B2 | 8/2013 | Feng et al. | |
| 9,938,610 | B2 | 4/2018 | Helmink et al. | |
| 11,198,927 | B1 | 12/2021 | Chaput et al. | |
| 2002/0185524 | A1 | 12/2002 | Zhao et al. | |
| 2007/0020136 | A1 * | 1/2007 | Menon | C22C 27/02 420/426 |
| 2015/0368754 | A1 | 12/2015 | Aimone et al. | |
| 2017/0159155 | A1 * | 6/2017 | Wang | C22C 27/02 |

FOREIGN PATENT DOCUMENTS

| | | | |
|---|---|---|---|
| EP | 377810 | A1 | 7/1990 |
| EP | 532658 | B1 | 3/1993 |
| EP | 372322 | B1 | 10/1993 |
| RU | 2625203 | C1 * | 7/2017 |
| RU | 2625203 | C1 | 7/2017 |
| WO | 9209713 | A1 | 6/1992 |

OTHER PUBLICATIONS

He, X.; Zhang, X.; Li, Y.; Huang, J.; Effect of Mo on microstructure and mechanical properties of Nb—Ti—C—B multiphase alloy Journal of Alloys and Compounds 2013, 551, 78-583.

Machine Translation of WO 9209713 A1.

Jan. 22, 2021, Non-final Office Action For U.S. Appl. No. 16/583,549.

May 10, 2021, Final Rejection For U.S. Appl. No. 16/583,549.

Aug. 6, 2021, Non-final Office Action For U.S. Appl. No. 16/583,549.

Philips, N.R.et al.; New opportunities in refractory alloys, Metall. Mater. Trans. 2020, 51, 3299-3310.

Couzinie, J.P.; et al. Comprehensive data compilation on the mechanical properties of refractory high-entropy alloys, Data in Brief, 2018, 21, pp. 1622-1641.

Brady, M.P. et al.; "Alloy design strategies for promoting protective oxide-scale formation," 2000, JOM 52, 16-21.

Giggins, C.S. et al.; "Oxidation of Ni—Cr—Al Alloys Between 1000° C. and 1200° C.", J. Electrochem. Soc. 1971, 118, 1782-1790.

U.S. Appl. No. 16/916,198, filed Jun. 30, 2020.

Jul. 26, 2021, Non-final Office Action For U.S. Appl. No. 16/916,198.

Oct. 8, 2021, Final Office Action For U.S. Appl. No. 16/916,198.

Machine Translation of RU2625203 C1.

* cited by examiner

NIOBIUM ALLOYS FOR HIGH TEMPERATURE, STRUCTURAL APPLICATIONS

CROSS-REFERENCE TO RELATED APPLICATION

The present application claims priority to U.S. patent application Ser. No. 16/916,198 filed Jun. 30, 2020, which in turn claims priority to U.S. Provisional Application Ser. No. 62/906,234 filed Sep. 26, 2019, the contents of U.S. patent application Ser. No. 16/916,198 and U.S. Provisional Application Ser. No. 62/906,234 hereby being incorporated by reference in their entry.

RIGHTS OF THE GOVERNMENT

The invention described herein may be manufactured and used by or for the Government of the United States for all governmental purposes without the payment of any royalty.

FIELD OF THE INVENTION

The present invention relates to Nb-based refractory alloys and processes of making and using same.

BACKGROUND OF THE INVENTION

Nb-based refractory alloys currently used in some high-temperature structural applications contain expensive and dense alloying elements. For example, C-103, which is one of the most commonly used medium-strength Nb alloys, contains (by atomic percent) 5.4 Hf, 0.3 Ta, 0.3 W, 0.7 Zr, 2.0 Ti, and remaining Nb; and a high strength C-3009 contains 19.2 Hf, 5.6 W and remaining Nb. Such metals as Hf, Ta and Zr are expensive, costing approximately $1200, $290 and $150 per kilogram, respectively, and Hf, W and Ta have high density of, respectively, 13.21, 16.65 and 19.25 g/cm$^3$. Moreover, these alloys have poor oxidation resistance above 600° C. and thus require oxidation resistive coatings. There has been extensive efforts put forth to solve the above mention problems including research on Nb alloys containing Si, which main goal is to improve both high temperature strength and oxidation resistance; however, Nb—Si alloys are generally brittle at temperatures ≤1000° C. and they have not found practical use yet. Refractory complex concentrated alloys (RCCAs) or refractory high entropy alloys (RHEAs) are another promising direction of research but such research has yet to result in a Nb-based refractory alloy that is known to solve the aforementioned problems.

In view of the foregoing, Applicants invented Nb-based refractory alloys that are less expensive and less dense than current Nb-based refractory alloys, yet which have similar or better ductility, high temperature strengths and oxidation resistance when compared to current Nb-based refractory alloys. Furthermore, Applicants' Nb-based refractory alloys typically continue to be compatible with current oxidation resistive coating systems that are employed to improve the oxidation resistance of Nb-based refractory alloys. Applicants disclose their improved Nb-based refractory alloys herein.

SUMMARY OF THE INVENTION

The present invention relates to Nb-based refractory alloys that are less expensive and less dense than current Nb-based refractory alloys, yet which have similar or better ductility, high temperature strengths and oxidation resistance when compared to current Nb-based refractory alloys. Such Nb-based refractory alloys typically continue to be compatible with current coating systems for Nb-based refractory alloys. Such Nb-based refractory alloys are disclosed herein.

Additional objects, advantages, and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated in and constitute a part of this specification, illustrate embodiments of the present invention and, together with a general description of the invention given above, and the detailed description of the embodiments given below, serve to explain the principles of the present invention.

Figure 1A:
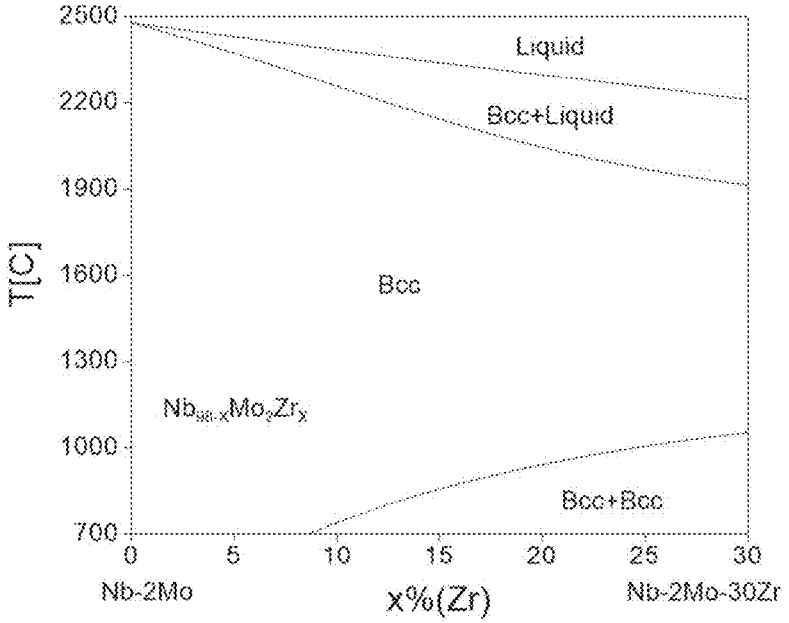
FIG. 1A is an equilibrium phase diagram of $Nb_{98-x}Mo_2Zr_x$ with x ranging from 0 at. % to 30 at. %.

It should be understood that the appended drawings are not necessarily to scale, presenting a somewhat simplified representation of various features illustrative of the basic principles of the invention. The specific design features of the sequence of operations as disclosed herein, including, for example, specific dimensions, orientations, locations, and shapes of various illustrated components, will be determined in part by the particular intended application and use environment. Certain features of the illustrated embodiments have been enlarged or distorted relative to others to facilitate visualization and clear understanding. In particular, thin features may be thickened, for example, for clarity or illustration.

DETAILED DESCRIPTION OF THE INVENTION

Definitions

Unless specifically stated otherwise, as used herein, the terms "a", "an" and "the" mean "at least one".

As used herein, the terms "include", "includes" and "including" are meant to be non-limiting.

Unless otherwise noted, all component or composition levels are in reference to the active portion of that component or composition, and are exclusive of impurities, for example, residual solvents or by-products, which may be present in commercially available sources of such components or compositions.

All percentages and ratios are calculated by weight unless otherwise indicated. All percentages and ratios are calculated based on the total composition unless otherwise indicated.

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

DETAILED DESCRIPTION OF THE INVENTION

Nb-based Refractory Alloys

For purposes of this specification, headings are not considered paragraphs and thus this paragraph is Paragraph 0030 of the present specification. The individual number of each paragraph above and below this paragraph can be determined by reference to this paragraph's number. In this Paragraph 0030, Applicants disclose a Nb—Mo—Zr alloy comprising Nb, about 5 atomic percent to about 20 atomic percent Mo, preferably about 10 atomic percent to about 20 atomic percent Mo, more preferably about 10 atomic percent to about 15 atomic percent Mo, and about 2 atomic percent to about 35 atomic percent Zr, preferably about 5 atomic percent to about 15 atomic percent Zr, more preferably about 5 atomic percent to about 10 atomic percent Zr.

The Nb—Mo—Zr alloy of paragraph thirty wherein Nb is the balance of said Nb—Mo—Zr alloy.

The Nb—Mo—Zr alloy of paragraph thirty wherein Nb is the balance of said Nb—Mo—Zr alloy.

The Nb—Mo—Zr alloy according to paragraph thirty-two wherein at least one of said elemental alloy additions is present at the following level:

a) from about 0.1 atomic percent to about 10 atomic percent Al, preferably from about 1.0 atomic percent to about 7.0 atomic percent Al, more preferably from about 2.0 atomic percent to about 4.0 atomic percent Al;
b) from about 0.1 atomic percent to about 3.5 atomic percent Fe preferably from about 0.1 atomic percent to about 2.0 atomic percent Fe, more preferably from about 0.5 atomic percent to about 1.8 atomic percent Fe;
c) from about 0.1 atomic percent to about 15 atomic percent Cr, preferably from about 0.1 atomic percent to about 10 atomic percent Cr, more preferably from about 1.0 atomic percent to about 5.0 atomic percent Cr;
d) from about 0.1 atomic percent to about 20 atomic percent Ti, preferably from about 1.0 atomic percent to about 15.0 atomic percent Ti, more preferably from about 5.0 atomic percent to about 10.0 atomic percent Ti;
e) from about 0.001 atomic percent to about 1.0 atomic percent C, preferably from about 0.001 atomic percent to about 0.1 atomic percent C, more preferably from about 0.001 atomic percent to about 0.03 atomic percent C;
f) from about 0.001 atomic percent to about 1.0 atomic percent N, preferably from about 0.001 atomic percent to about 0.1 atomic percent N, more preferably from about 0.001 atomic percent to about 0.03 atomic percent N;
g) from about 0.001 atomic percent to about 1.0 atomic percent O, preferably from about 0.001 atomic percent to about 0.1 atomic percent O, more preferably from about 0.001 atomic percent to about 0.03 atomic percent O.

The Nb—Mo—Zr alloy according to paragraph thirty-three comprising two, three, four, five, six or seven of said elemental alloy additions.

The Nb—Mo—Zr alloy according to paragraphs thirty-three through thirty-four, said Nb—Mo—Zr alloy comprising a total of no more than about 15 atomic percent of combined Al, Cr and Fe elemental alloy additions. Exceeding 15 atomic percent in some embodiments may increase brittleness.

The Nb—Mo—Zr alloy according to paragraphs thirty through thirty-five in which elemental impurities are present in a total amount not exceeding about 2 atomic percent, preferably in a total amount not exceeding about 1 atomic percent, more preferably in a total amount not exceeding about 0.5 atomic percent. In a total amount not exceeding the recited atomic percent means that any elemental impurities present will not be greater that about the recited percentage.

The Nb—Mo—Zr alloy according to paragraph thirty-six in which said elemental impurities are any elements not recited by paragraphs thirty through thirty-three.

An article comprising a Nb—Mo—Zr alloy according to any of paragraphs thirty through thirty-seven, said article being selected from the group consisting aircraft, spacecraft, munition, ship, vehicle, thermal protection system, land power generation system; preferably said article comprises a nuclear reactor, engine, and/or airframe that comprises said Nb—Mo—Zr alloy.

Figure 1B:
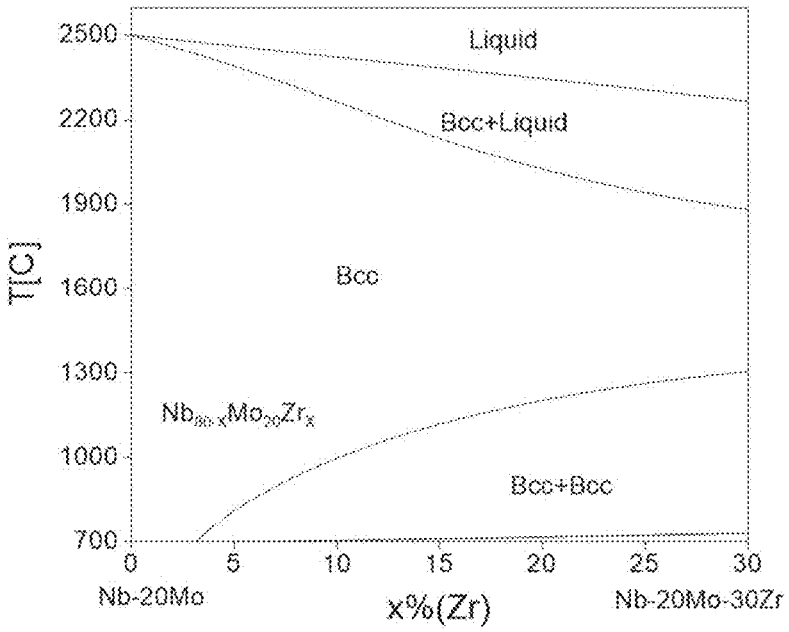
FIG. 1B is an equilibrium phase diagram of $Nb_{85-x}Mo_{15}Zr_x$ with x ranging from 0 at. % to 30 at. %.

The Nb—Mo—Zr alloys containing 5 at. % to 20 at. % Mo and 2 at. % to 35 at. % Zr are single-phase or two-phase body center cubic (BCC) structures over a wide temperature range. FIGS. 1A and 1B respectively illustrate equilibrium phase diagrams of $Nb_{98-x}Mo_2Zr_x$ and $Nb_{85-x}Mo_{15}Zr_x$ systems, with x ranging from 0 at. % to 30 at. % and the subscript numbers indicating the amount of the respective element in atomic percent. At the concentrations of Zr below 4 at. % the Nb—Mo—Zr alloys are single-phase BCC structures. At the concentrations of Zr between 4 at. % and 30 at. % some of the Nb—Mo—Zr alloys have two BCC phases below 1300° C. FIG. 1 also shows that the claimed Nb—Mo—Zr alloys have high melting temperature exceeding 1900° C., which make them potential candidates for high-temperature applications, including those operated above 1000° C.

Figure 2A:
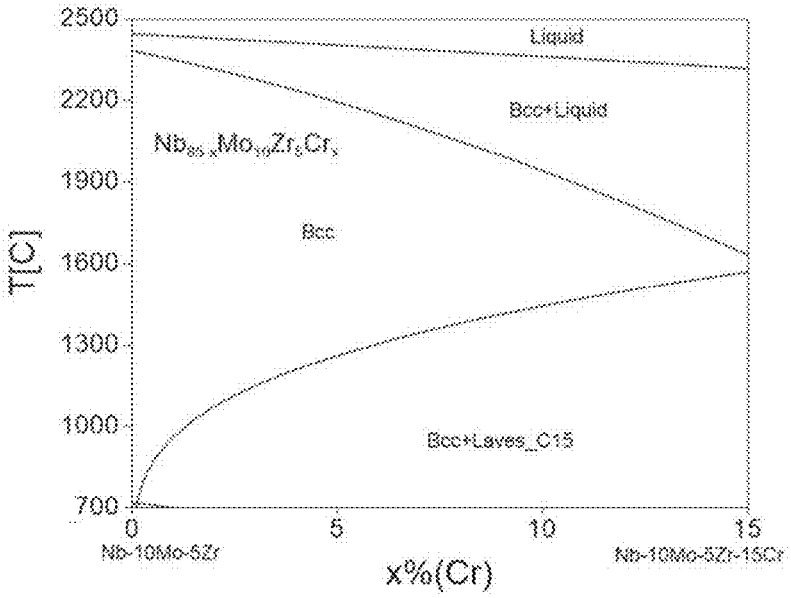
FIG. 2A is an equilibrium phase diagram of an $Nb_{85-n}Mo_{10}Zr_5Cr_x$ alloy system with x ranging from 0 at. % to 15 at. %.
Figure 2B:
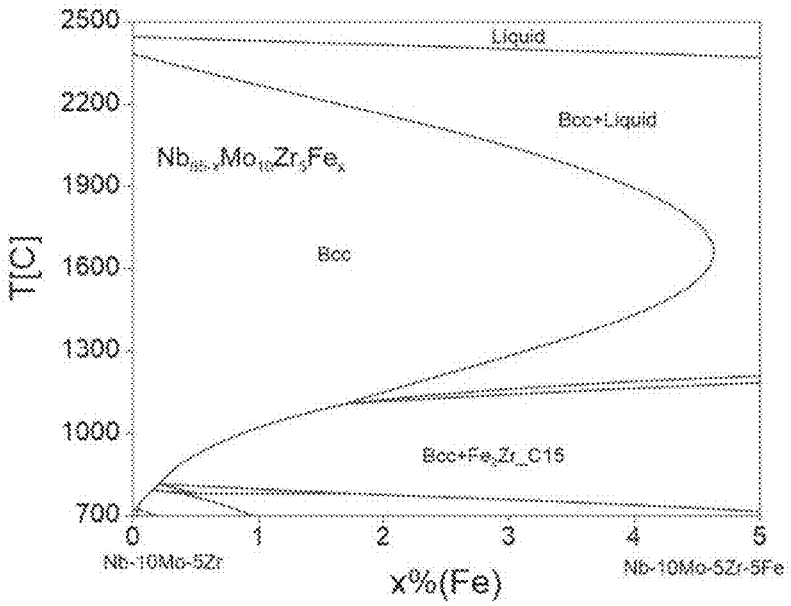
FIG. 2B is an equilibrium phase diagram of an $Nb_{85-x}Mo_{10}Zr_5Fe_x$ alloy system with x ranging from 0 at. % to 5 at. %.
Figure 2C:
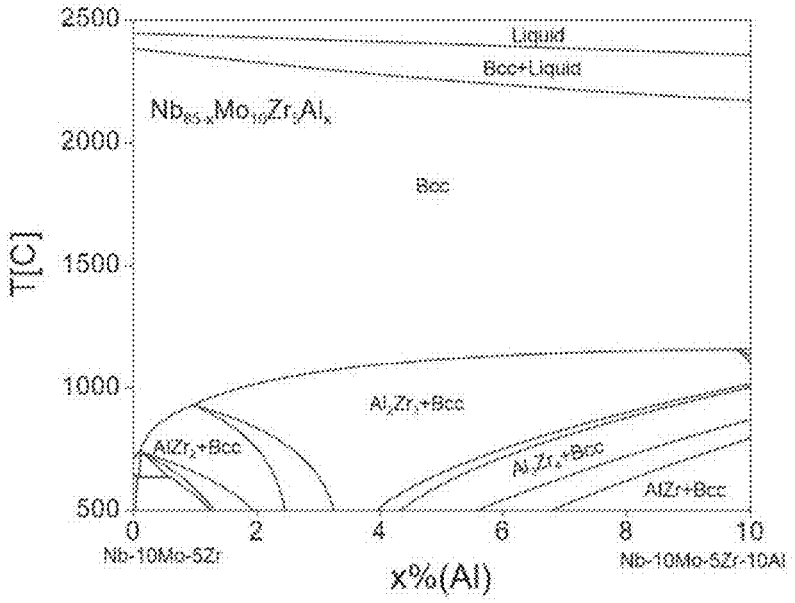
FIG. 2C is an equilibrium phase diagram of an $Nb_{85-x}Mo_{10}Zr_5Al_x$ alloy system with x ranging from 0 at. % to 10 at. %.
Figure 2D:
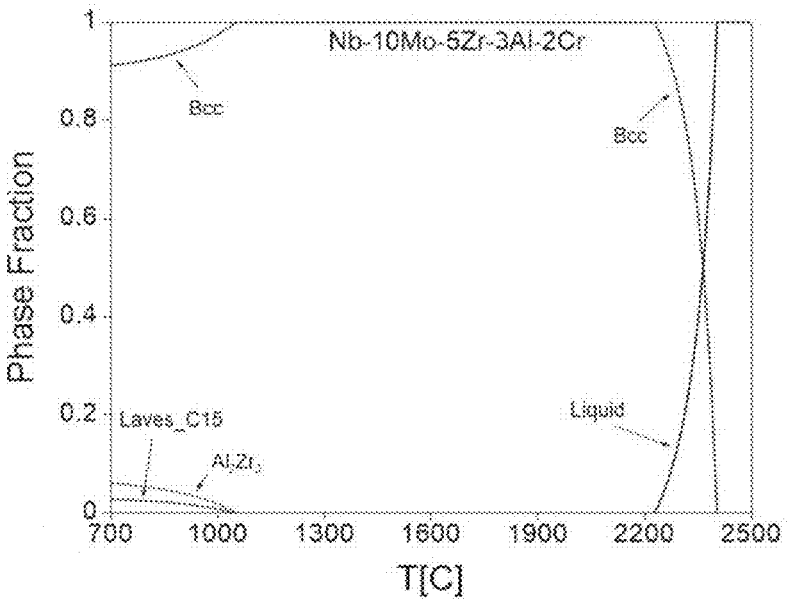
FIG. 2D is an equilibrium phase diagram of an $Nb_{85-x}Mo_{10}Zr_5Ti_x$ alloy system with x ranging from 0 at. % to 15 at. %.
Figure 3A:
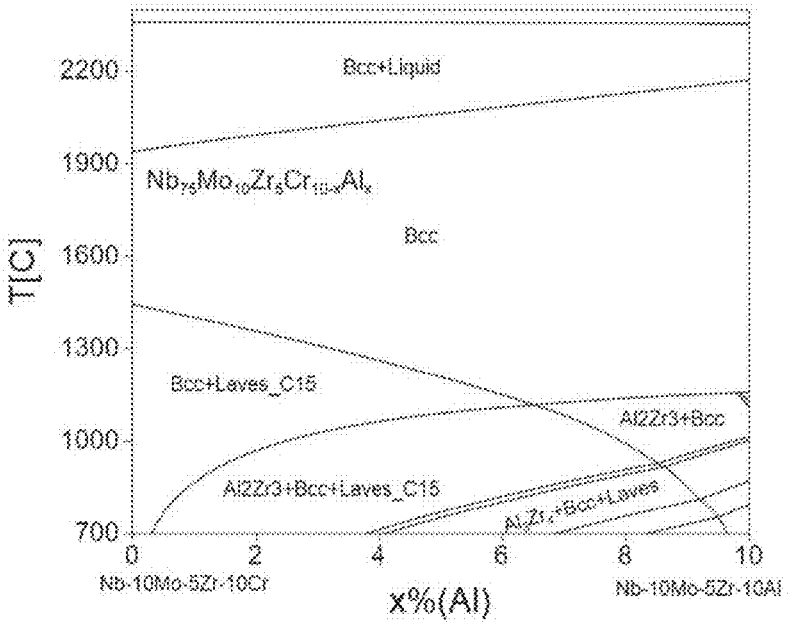
FIG. 3A is an equilibrium phase diagram of an $Nb_{75}Mo_{10}Zr_5Cr_{10-x}Al_x$ alloy system with x ranging from 0 at. % to 10 at. %.
Figure 3B:
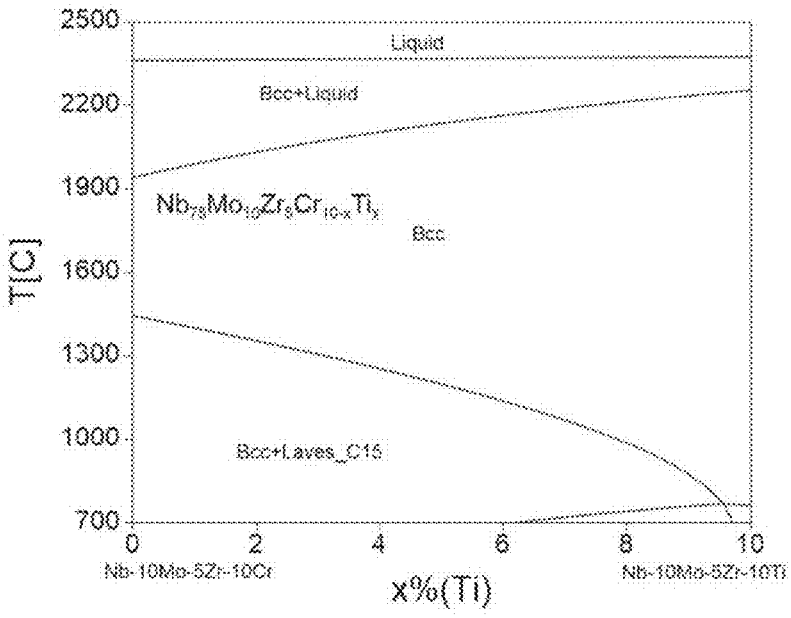
FIG. 3B is an equilibrium phase diagram of an $Nb_{75}Mo_{10}Zr_5Cr_{10-x}Ti_x$ alloy system with x ranging from 0 at. % to 10 at. %.
Figure 3C:
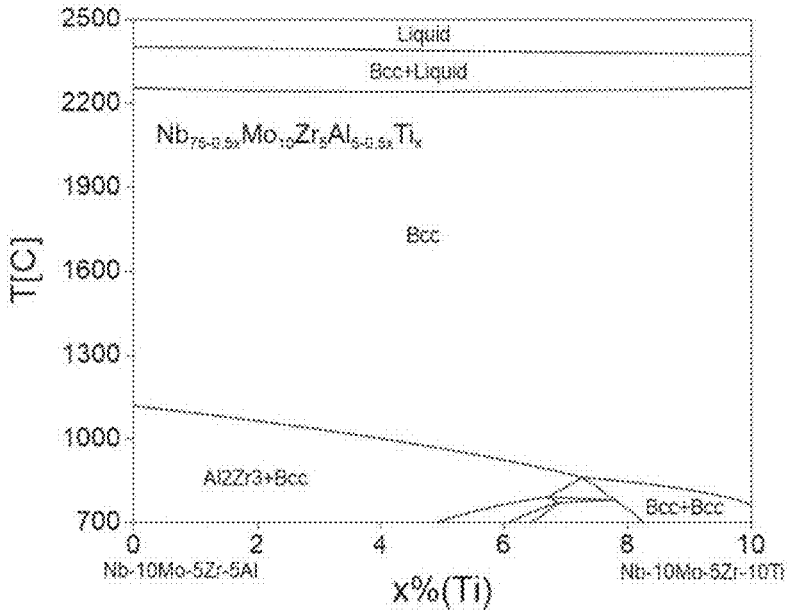
FIG. 3C is an equilibrium phase diagram of an $Nb_{75-0.5x}Mo_{10}Zr_5Al_{5-0.5x}Ti_x$ alloy system with x ranging from 0 at. % to 10 at. %.
Figure 3D:
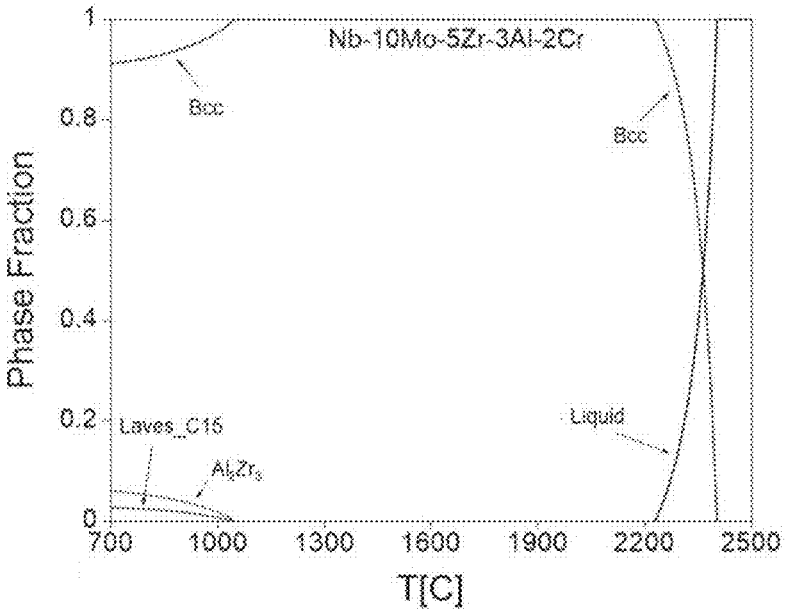
FIG. 3D is an equilibrium phase diagram of an $Nb_{80}Mo_{10}Zr_5Al_3Cr_2$ alloy.

FIGS. 2A through 2D are, respectively equilibrium phase diagrams of $Nb_{85-x}Mo_{10}Zr_5Cr_x$, $Nb_{85-x}Mo_{10}Zr_5Fe_x$ $Nb_{85-x}Mo_{10}Zr_5Al_x$, and $Nb_{85-x}Mo_{10}Zr_5Ti_x$ alloy systems. FIGS. 2A and 2B show that additions of Cr and/or Fe results in the formation of a secondary Laves phase, which can provide precipitation strengthening at temperatures up to 1500° C. The presence of a single-phase BCC region at high temperatures and two-phase, BCC+Laves, region below the Laves solvus line makes these alloys heat treatable, which allows controlling mechanical properties. FIG. 2C shows that aluminum forms numerous intermetallic phases with Zr; therefore, addition of Al is beneficial for precipitation strengthening, especially at temperatures below 1000° C. FIG. 2D illustrates that Ti does not form additional phases when it is added to the Nb—Mo—Zr alloys; however, it is known as an element that improves workability and oxidation resistance of Nb alloys.

FIGS. 3A through 3D respectively illustrate equilibrium phase diagrams of $Nb_{75}Mo_{10}Zr_5Cr_{10-x}Al_x$, $Nb_{75}Mo_{10}Zr_5Cr_{10},Ti_x$, and $Nb_{75-0.5x}Mo_{10}Zr_5Al_{5-0.5x}Ti_x$ alloy systems and $Nb_{80}Mo_{10}Zr_5Al_3Cr_2$ alloy, —all consisting of 5 components. The phase diagrams show that the simultaneous alloying of Nb—Mo—Zr alloys with Al and Cr, Al and Ti, and/or Cr and Ti results in the formation of secondary phases, which make the alloys heat treatable and allows additional precipitation strengthening.

Figure 4:
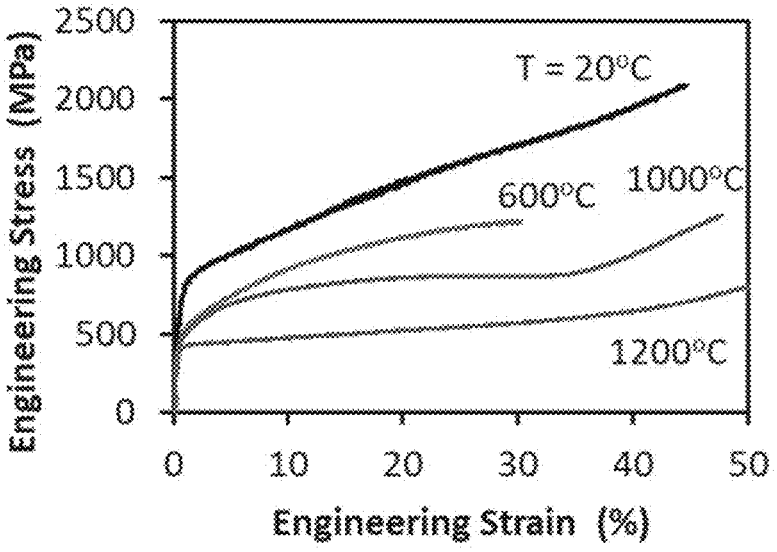
FIG. 4 is a series of stress vs. strain curves of Nb-10Mo-5Zr-3Al-2Cr alloy obtained during compression deformation at 20° C., 600° C., 1000° C. and 1200° C. with a strain rate of 0.001 $s^{-1}$

FIG. 4 illustrates, as an example, typical stress vs. strain curves of Nb-10Mo-5Zr-3Al-2Cr alloy obtained during compression deformation at 20° C., 600° C., 1000° C. and 1200° C. with a strain rate of 0.001 $s^{-1}$. In the temperature range of 20° C. to 1200° C. the alloy is ductile and can easily be forged or rolled.

Figure 5A:
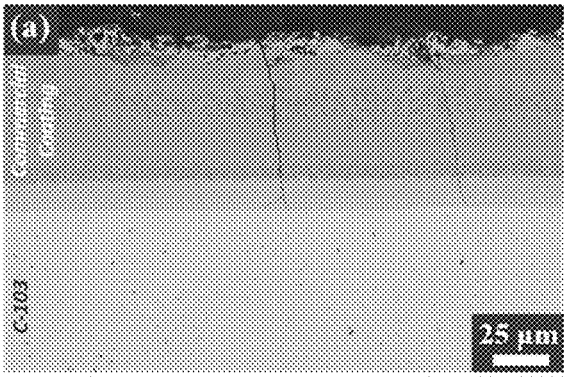
FIG. 5A is a cross-section backscattered electron image of as-deposited commercial R512E slurry coating on commercial C103 alloy.
Figure 5B:
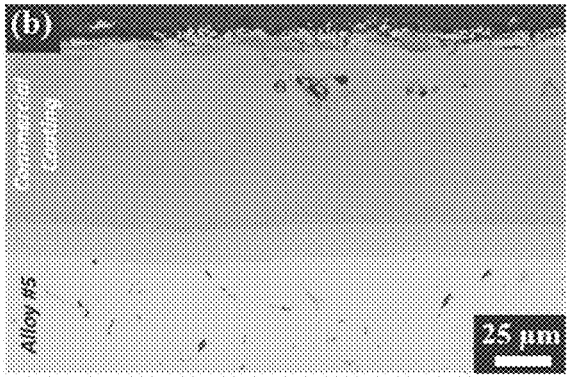
FIG. 5B is a cross-section backscattered electron image of as-deposited commercial R512E slurry coating on Nb-10Mo-5Zr-3Al-2Cr alloy.
Figure 5C:
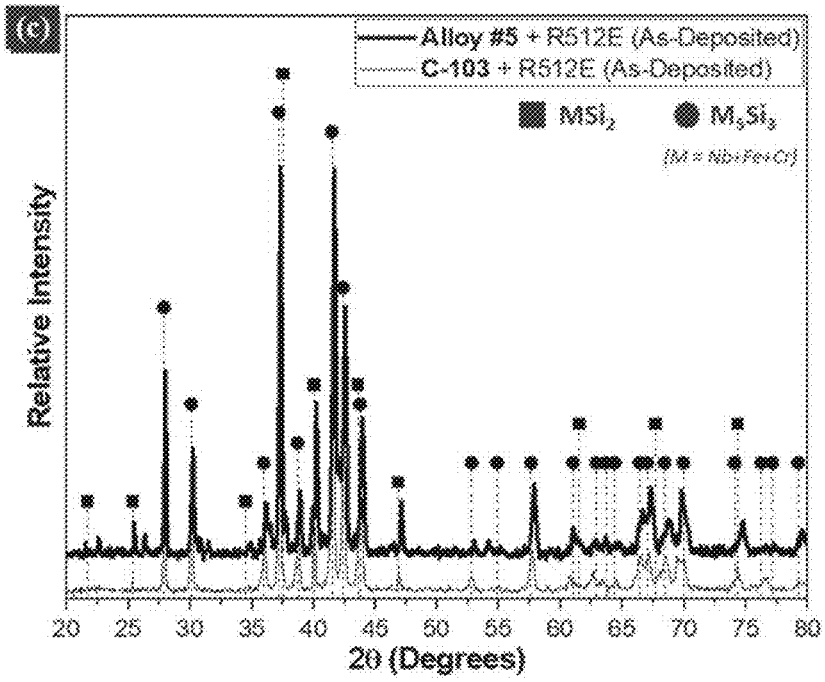
FIG. 5C is X-ray diffraction spectra, captured in plan-view, from as-deposited commercial R512E slurry coating on commercial C103 alloy (thin-line) and Nb-10Mo-5Zr-3Al-2Cr alloy (thick line). Peaks relating to mixed silicide phases containing Nb, Fe, and Cr are shown for reference.

FIGS. 5A and 5B illustrate, as an example, the commercial slurry coating integration and compatibility of Nb-10Mo-5Zr-3Al-2Cr alloy (Alloy #5), as compared with commercial C103 alloy. In particular, FIGS. 5A and 5B show cross-section microstructures of commercially deposited R512E slurry coating on commercial C103 and Nb-10Mo-5Zr-3Al-2Cr alloys, respectively. The Nb-10Mo-5Zr-3Al-2Cr alloy exhibits similar integration of the coating as compared to commercial C103. In addition, FIG. 5C shows X-ray diffraction measurements of the as-deposited coatings on the Nb-10Mo-5Zr-3Al-2Cr alloy and commercial C103 alloy. It is observed that the Nb-10Mo-5Zr-3Al-2Cr alloy forms similar distribution of silicide phases compared to the coated commercial C103 alloy, as is shown by the crystallographic signatures, indicating similar compatibility of these two alloys with commercial R512E slurry coating.

Figure 6:
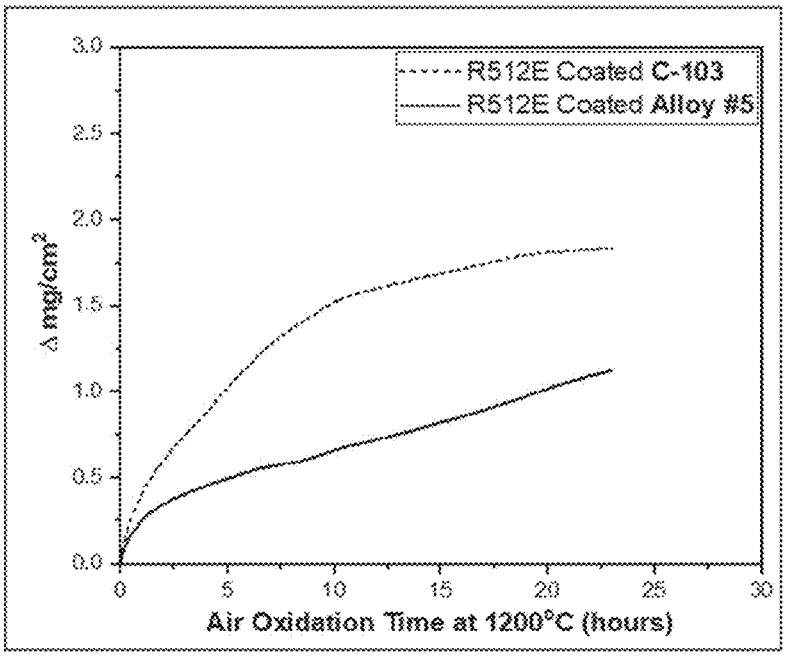
FIG. 6 is a specific mass change (mg/cm$^2$) plot vs time for oxidation in air at 1200° C. of R512E commercial slurry coated Nb-10Mo-5Zr-3Al-2Cr alloy (Alloy #5) and R512E commercial slurry coated C103 alloy.

FIG. 6 illustrates the oxidation kinetics of the alloys coated with the commercial R512E slurry. Based on this data and testing conditions, the coated Nb-10Mo-5Zr-3Al-2Cr alloy exhibits slightly lower, yet comparable mass gain up to 24 hours of oxidation in air at 1200° C. compared to coated commercial C103 alloy, indicating no significant loss in oxidation resistance after commercial R512E slurry coating integration on the Nb-10Mo-5Zr-3Al-2Cr alloy.

The high temperature strength of Nb based refractory solid solution alloys were predicted using the Suzuki model of substitutional solid solution strengthening in BCC alloys. Within the Suzuki model, the critical resolved shear stress for the motion of a/2[111]screw dislocations, $\tau_y$, where the motion of kinks overcoming solute obstacles is rate controlling, can be decomposed into two parts as:

$$\tau_y=\mathrm{Min}(\tau_k+\tau_j) \tag{1}$$

where Min indicates minimum of, $\tau_j$ is taken as the Orowan bowing stress between interstitial/vacancy dipoles formed on the screw dislocation line due to kink-kink collisions, $\tau_k$ is the stress required to move the kinks over solute obstacles in-between the dipoles. Equation (1) assumes that the Orowan equation applies for screw dislocations bowing between interstitial dipoles as $$\tau_j=\mu b/(4L) \tag{2}$$

where '2L' is the spacing between dipoles, μ is the shear modulus and 'b' is the Burgers vector of the a/2[111] screw dislocation. A fourth order algebraic equation is used to determine $\tau_k$:

$$\tau_k^4+S\tau_k-R=0 \tag{3}$$

where $$S=[18\kappa^2E_W^2ckT/(a_p^3b^4\Lambda_k^2)]*1n[(5\pi kT)^2v_0a_pb/((\mu b\Delta V)^2\varepsilon^*)] \tag{4a}$$

$$R=27\kappa^4E_W^4c^2/(a_p^4b^6\Lambda_k^2) \tag{4b}$$

$$\Delta V=3\kappa^2E_W^2c/(2\tau_k^2a_pb^2)+\tau_k^2a_p^3b^4\Lambda_k^2/(6\kappa^2E_W^2c) \tag{4c}$$

$$1/(2\pi)^{0.5}\int^{\infty\kappa}\exp(-x^2/2)dx=b/(3Lc) \tag{4d}$$

The activation energy for kinks overcoming the solute obstacles, ΔH, is simply $$\Delta H=3cE_W^2\kappa^2/(2\tau_ka_pb^2)-\tau_k^3a_p^3b^4\Lambda_k^2/(18\kappa^2E_w^2c) \tag{5}$$

In equations (4, 5), $\Lambda_k$ is the kink width (~10b), ΔV is the activation volume for kinks overcoming solute obstacles, $v_0$ is the Debye frequency (~$5*10^{12}$), T is the temperature, k is the Boltzmann constant and ε* is the shear strain rate. Equations (1), (2), (3) and (4) are modelled numerically by minimizing equation (1) with respect to κ, for a certain T, ε* , c and $E_{int}$. The $E_{int}$ values for different solutes present in the disclosed Nb alloys are directly derived from atomistic simulations using the average interatomic potential and are given in Table 1. The sum of the contributions from various solutes are summed up as:

$$\tau=[\Sigma_i(\tau_i)^{1/q}]^q \tag{5}$$

where τ is the net critical stress required for the motion of a/2[111] screw dislocations, $\tau_i$ is the contribution from each solute evaluated using Equations (1-5). In Eq.(6), the concentration dependence of the contribution from each solute, $\tau_i$, is written as:

$$\tau_i\Theta_i(c_i)^q \tag{7}$$

where $\Theta_i$, is a constant, $c_i$ is the concentration of solute 'i' and q are constants directly derived from Eqs.(1-4). To compare with experimental yield stress data, such a derived critical stress is multiplied by the approximate Taylor factor (=2.7) for BCC structures.

Table 1. Solute—screw dislocation core interaction energies ($E_{int}^{d}$), for the solutes Mo, Zr, Al, Cr, Fe and Ti in the Nb alloys evaluated using an average representation of the Zhou interatomic potentials. All results are in eV.

| Solute | $E_{int}^{d}$ |
|---|---|
| Mo | 0.104 |
| Zr | −0.125 |
| Al | −0.194 |
| Cr | 0.254 |
| Fe | −0.158 |
| Ti | −0.078 |

Process of Making Nb-based Refractory Alloys

The alloys can be made using different processing methods, which may include, but are not limited to, mixing, melting, casting, powder metallurgy making and processing, cold and hot working, heat treatment and/or thermo-mechanical treatment. The alloys can be used in the form of cast products, powder metallurgy products including additive manufacturing, worked (rolled, forged, extruded, etc.) products, in the as-produced, annealed or heat treated conditions.

Test Methods

Compression rectangular test specimens with the dimensions of 4.6 mm×4.6 mm×7.6 mm were electric discharge machined (EDM) from larger pieces of alloy material and their surfaces were polished with a 400 grit SiC paper. The specimens were compression deformed along the longest direction at different temperatures and a rams speed of 0.0076 mm/s. The room temperature tests were conducted in air and high temperature tests were conducted in a $10^{-5}$ Torr vacuum.

Oxidation test specimens were electric discharge machined (EDM) from larger pieces of alloy material. Uncoated oxidation samples were sectioned into a rectangular geometries measuring 4.6 mm×4.6 mm×7.4 mm. Samples intended for coating and subsequent oxidation were sectioned into disks with 9.5 mm diameter and 3.2 mm thickness. In all cases, recast layers were removed using coarse grinding paper, followed by standard metallographic techniques up to a 600 grit finish and finally cleaned in isopropanol. Commercial R512E slurry coatings were applied to the "disk" specimens by a commercial vendor using standard techniques developed for coating commercial C103 alloys. All subsequent oxidation tests (coated and uncoated specimens) were conducted using a thermogravimetric analyzer (TGA) using bottled air for reaction gas and ultra-high purity argon for the balance gas. Specimens were heated under inert atmosphere and then subsequently oxidized in air at 1200° C. Only data captured during the oxidation regime (in air) is represented here.

EXAMPLES

The following examples illustrate particular properties and advantages of some of the embodiments of the present invention. Furthermore, these are examples of reduction to practice of the present invention and confirmation that the principles described in the present invention are therefore valid but should not be construed as in any way limiting the scope of the invention.

While the alloys of the present invention can be made by a number of methods, to prove the concept, five Nb alloys, which composition (in at. %) is shown in Table 2 were produced by vacuum arc melting. The density of the produced alloys is in the range from 7.56 g/cm$^3$ for alloy #4 to 8.58 g/cm$^3$ for alloy #2, which is considerably smaller than the density of commercial alloys C103 (8.86 g/cm$^3$) or C-3009 (10.3 g/cm$^3$).

Compression deformation behavior of the alloy #5 is shown in FIG. 4 as an example. In the temperature range of 20° C. to 1200° C. the alloys are ductile and can easily be forged or rolled. The yield strength values are given in Table 3 and the specific yield strength values are given in Table 4 and compared with the properties of commercial alloys C-103 and C-3009. All produced alloys are stronger than C-103. Alloy #2 is stronger than C-3009 in the temperature range of 800° C.-1200° C. Alloy #5 is stronger than C-3009 at temperatures up to 1000° C. and at 1200° C. its yield strength is the same as that of C-3009. The specific yield strength values of the disclosed alloys are noticeably better than those of C-103 and C-3009 in the whole temperature range (Table 4).

TABLE 2

Chemical composition (in at. %) and density (g/cm$^3$) of the produced alloys.

| Alloy ID | Density (g/cm$^3$) | Mo | Zr | Ti | Cr | Al | Nb |
|---|---|---|---|---|---|---|---|
| #1 | 8.52 | 12.8 ± 0.1 | 8.7 ± 0.2 | 0 | 0 | 0 | 78.5 ± 0.2 |
| #2 | 8.58 | 17.2 ± 0.2 | 8.7 ± 0.1 | 0 | 0 | 0 | 74.1 ± 0.2 |
| #3 | 8.33 | 12.6 ± 0.1 | 8.5 ± 0.1 | 5.0 ± 0.1 | 0 | 0 | 73.9 ± 0.1 |
| #4 | 7.56 | 7.7 ± 0.2 | 34.6 ± 0.4 | 6.6 ± 0.1 | 1.7 ± 0.1 | 0 | 49.4 ± 0.3 |
| #5 | 8.40 | 14.2 ± 0.7 | 6.7 ± 0.9 | 0 | 1.0 ± 0.1 | 2.3 ± 0.1 | 75.8 ± 0.3 |

Table 3 also compares the experimentally determined yield stress values with those calculated using Equation (7) for the alloy #5 and shows satisfactory agreement in the whole temperature range. The room temperature and 1200C strength values for two other alloys: Nb-10Mo-5Zr-5Cr and Nb-10Mo-3Zr-2Fe-5Cr; calculated using Eq. 6 are as follows: 1211 and 422 MPa & 1247 and 439 MPa.

TABLE 3

Yield strength (in MPa) of produced alloys #1 through #5 and commercial alloys C-103 and C-3009 at different temperatures.

| | T, ° C. | | | | | |
|---|---|---|---|---|---|---|
| Alloy ID | 25 | 800 | 1000 | 1200 | 1400 | 1600 |
| #1 | 587 | 376 | 364 | 338 | 264 | 148 |
| #2 | 632 | 441 | 417 | 390 | 301 | 188 |
| #3 | 690 | 417 | 414 | 343 | 247 | 139 |
| #4 | 1240 | 438 | 379 | 211 | 83 | 23.6 |
| #5 | 779 | 470 | 430 | 383 | 253 | 119 |

TABLE 3-continued

Yield strength (in MPa) of produced alloys #1 through #5 and commercial alloys C-103 and C-3009 at different temperatures.

| | T, ° C. | | | | | |
|---|---|---|---|---|---|---|
| Alloy ID | 25 | 800 | 1000 | 1200 | 1400 | 1600 |
| #5 Predicted, Eq. (7) | 1105 | 487 | | 385 | | |
| C-103 | 296 | 169 | 145 | 115 | 50 | — |
| C-3009 | 663 | 424 | 397 | 388 | 288 | 127 |

TABLE 4

Specific yield strength (in MPa/cm$^3$/g) of Nb-10Mo-5Zr-3Al-2Cr alloy and C-3009 alloy at different temperatures.

| | T, ° C. | | | | | |
|---|---|---|---|---|---|---|
| | 20 | 800 | 1000 | 1200 | 1400 | 1600 |
| #1 | 68.9 | 44.1 | 42.7 | 39.7 | 31.0 | 17.4 |
| #2 | 73.7 | 51.4 | 48.6 | 45.5 | 35.1 | 21.9 |
| #3 | 82.8 | 50.1 | 49.7 | 41.2 | 29.7 | 16.7 |
| #4 | 164.0 | 57.9 | 50.1 | 27.9 | 11.0 | 3.1 |
| #5 | 92.7 | 56.0 | 51.2 | 45.0 | 30.1 | 14.2 |
| C-103 | 33.4 | 19.1 | 16.4 | 13.0 | 5.6 | — |
| C-3009 | 64.4 | 41.2 | 38.5 | 37.7 | 28.0 | 12.3 |

Commercial R512E slurry coating integration on alloy #5, as compared to commercial C103 alloy is shown in FIGS. 5A and FIG. 5B. Inspection of each cross-section microstructure in the as-deposited coating condition, as in FIG. 5A and FIG. 5B, demonstrates that the compatibility of R512E on alloy #5 is very similar to the behavior on the C103 alloy. This data shows that the integration, adhesion, and mixtures of formed silicides are very similar considering this particular coating on alloy #5 and C103 alloy.

FIG. 6 demonstrates that commercial R512E slurry coated alloy #5 exhibits slightly lower, yet comparable oxidation kinetics compared to commercial R512E slurry coated C103 alloy. This data also shows that alloy #5 maintains reasonable coating compatibility and performance, as compared to commercial R512E slurry coated C103 alloy.

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While the present invention has been illustrated by a description of one or more embodiments thereof and while these embodiments have been described in considerable detail, they are not intended to restrict or in any way limit the scope of the appended claims to such detail. Additional advantages and modifications will readily appear to those skilled in the art. The invention in its broader aspects is therefore not limited to the specific details, representative apparatus and method, and illustrative examples shown and described. Accordingly, departures may be made from such details without departing from the scope of the general inventive concept.

What is claimed is:

1. A Nb—Mo—Zr alloy consisting of about 10 atomic percent to about 20 atomic percent Mo, about 5 atomic percent to about 15 atomic percent Zr; at least six elemental alloy additions selected from the group consisting of Al, Ti, Fe, Cr, C, N, and O one of said at least six elemental alloy additions being Cr, said elemental alloy additions being present at the following level:

a) from about 2.0 atomic percent to about 4.0 atomic percent Al;
b) from about 0.5 atomic percent to about 1.8 atomic percent Fe;
c) from about 0.1 atomic percent to about 1.0 atomic percent Cr;
d) from about 5.0 atomic percent to about 10.0 atomic percent Ti;
e) from about 0.001 atomic percent to about 0.03 atomic percent C;
f) from about 0.001 atomic percent to about 0.03 atomic percent N;
g) from about 0.001 atomic percent to about 0.03 atomic percent O;

and no more than about 1 total atomic percent elemental impurities, said elemental impurities being selected from elements other than Nb, Mo, Zr, Al, Ti, Fe, Cr, C, N and the balance of said Nb—Mo—Zr alloy being Nb.

2. The Nb—Mo—Zr alloy of claim 1 comprising about 10 atomic percent to about 15 atomic percent Mo, and about 5 atomic percent to about 10 atomic percent Zr.

3. The Nb—Mo—Zr alloy according to claim 1 in which said elemental impurities are present in a total amount not exceeding about 0.5 atomic percent.

4. An article comprising a Nb—Mo—Zr alloy according to claim 1, said article being selected from the group consisting of aircraft, spacecraft, munition, ship, vehicle, thermal protection system, and land power generation system.

5. An article according to claim 4, said article comprising a nuclear reactor, engine, and/or airframe that comprises said Nb—Mo—Zr alloy.

6. The Nb—Mo—Zr alloy according to claim 1 comprising seven of said elemental alloy additions.

* * * * *